United States Patent [19]

Baba et al.

[11] Patent Number: 4,571,979

[45] Date of Patent: Feb. 25, 1986

[54] DOUBLE ACTING PRESS FOR SHEET METAL FORMING

[75] Inventors: Kiyokazu Baba; Nao-aki Ikeoka, both of Komatsu, Japan

[73] Assignee: Kabushiki Kaisha Komatsu Seisakusho, Tokyo, Japan

[21] Appl. No.: 687,224

[22] Filed: Dec. 28, 1984

[30] Foreign Application Priority Data

Dec. 28, 1983 [JP] Japan ..... 58-199407[U]

[51] Int. Cl.[4] ..... B21D 22/00

[52] U.S. Cl. ..... 72/350; 72/347

[58] Field of Search ..... 72/347–350

[56] References Cited

U.S. PATENT DOCUMENTS

| | | | |
|---|---|---|---|
| 3,115,678 | 12/1963 | Keen et al. | 72/350 |
| 3,314,275 | 4/1967 | Mullen | 72/350 |
| 3,344,646 | 10/1967 | Moller | 72/350 |
| 4,090,389 | 5/1978 | Denderen | 72/350 |
| 4,309,888 | 1/1982 | Miller | 72/349 |
| 4,489,584 | 12/1984 | Gall | 72/350 |

*Primary Examiner*—Leon Gilden

*Attorney, Agent, or Firm*—Armstrong, Nikaido, Marmelstein & Kubovcik

[57] ABSTRACT

A double acting press has a die carried by an upper slide thereby to be forced downwardly to engage a sheet metal blank between itself and a hollow blank holder, and a punch accommodated in the blank holder and thrusted upwardly by a lower slide for pressing the blank against the die. The blank to be formed must be placed horizontally on the fixed blank holder and the punch being held flush therewith in its lowermost position. In order to adjustably vary this lowermost position of the punch relative to the blank holder, a floating plate rigidly carrying the punch thereon is made to rest on a floating plate rest as the lower slide descends out of engagement with the floating plate. The floating plate rest is supported by upstanding worms in threaded engagement therewith. A bidirectional electric motor is coupled to the worms via shafting and gearing to cause joint rotation thereof in either direction and, in consequence, the upward or downward displacement of the floating plate rest. A change in the vertical position of the floating plate rest results in a change in the lowermost position of the punch with respect to the blank holder.

4 Claims, 3 Drawing Figures

48
46
B
10
26
28
12
32
66
66
36
34
18
22
16
58

DOUBLE ACTING PRESS FOR SHEET METAL FORMING

BACKGROUND OF THE INVENTION

Our invention concerns a press for sheet metal forming, and more specifically to a press of the double acting variety, having a die forced downwardly to engage a sheet metal blank between itself and a blank holder, and a punch thrusted upwardly to press the blank against the die. Still more specifically, our invention pertains to means in such a double acting press for adjustably varying the lowermost position of the punch with respect to the blank holder in order to allow the blank to be placed horizontally on the punch and the blank holder.

A double acting press has been known which comprises a die carried by an upper slide thereby to be forced downwardly to engage a sheet metal blank against a hollow blank holder, and a punch received in the blank holder and pushed upwardly by a lower slide to press the blank against the die. While the upper slide rigidly carries the die, the lower slide is not coupled thereto but moves into and out of abutting engagement therewith. Upon full descent of the lower slide, the punch comes to rest on ledges projecting interiorly from the hollow blank holder, allowing the lower slide to move out of engagement with the punch. The punch when resting on the blank holder ledges is in its normal, lowermost position, from which it is to be raised by the punch as the latter subsequently ascends into abutment against the punch.

In a double acting press of this type, the blank to be formed is placed horizontally on the blank holder while the punch is in its lowermost position. The punch when in its lowermost position must have its top flush with the top of the blank holder to hold the blank thereon in cooperation with the blank holder. Should the punch top be lower than the blank holder top, the blank might sag in the middle under its own weight, particularly when it is of large size. If the punch top were higher than the blank holder top, on the other hand, then the blank would not be neatly placed on the blank holder in the correct horizontal attitude. In either case, the formed part would suffer defects such as wrinkles and wavy edges.

Conventionally, the double acting press of this kind has had no built in means for the adjustment of the lowermost position of the punch with respect to the blank holder, the punch having been placed on the blank holder ledges when in its lowermost position. Common practice, then, has been to shim the punch on the blank holder ledges. We object to this conventional practice because of too much time and labor involved.

SUMMARY OF THE INVENTION

We have hereby invented a simple and practical solution to the problem, in a double acting press of the class defined, of how to readily adjust the lowermost position of the punch relative to the blank holder, in order that a blank to be formed may be neatly placed on the blank holder and the punch being held in a coplanar relation to each other.

Basically, our invention is directed to a double acting press of the type having a hollow blank holder mounted in a substantially fixed relation to a bed, and a punch disposed within the blank holder and moved up and down motion relative to the same by a lower slide, the blank holder coacting with the punch being held in a lowermost position therein for holding thereon a blank to be formed. The blank is formed by being caught between the blank holder and a die forced downwardly by an upper slide and by being pressed against the die by the punch forced upwardly by the lower slide.

Characteristically, our invention further provides a floating plate rigidly mounted to the underside of the punch for joint up and down motion therewith, a floating plate rest disposed under the floating plate and itself movable up and down relative to the bed, and drive means for adjustably moving the floating plate rest up and down relative to the bed. The lower slide is movable into and out of abutting engagement with the floating plate to cause the up and down motion of the punch relative to the blank holder. During the downward stroke of the lower slide, the floating plate engages the floating plate rest and rests thereon, allowing the lower slide to move out of abutting engagement with the floating plate. The punch on the floating plate is in its lowermost position when the floating plate thus rests on the floating plate rest.

The drive means may preferably take the form of upstanding worms making threaded engagement with the floating plate rest and driven from a common bidirectional electric motor. Thus, in the above improved double acting press of our invention, the lowermost position of the punch is readily adjustable to the fixed position of the blank holder merely by rotating the drive motor in a desired direction and so by correspondingly changing the vertical position of the floating plate rest. The punch when in its lowermost position may thus be held flush with the blank holder so that the blank to be formed may be placed exactly in a horizontal plane on the blank holder and the punch.

The above and other features and advantages of our invention and the manner of realizing them will become more apparent, and the invention itself will best be understood, from a study of the following description and appended claims, with reference had to the attached drawings showing a preferred embodiment of our invention.

DESCRIPTION OF THE PREFERRED EMBODIMENT

Figure 1:
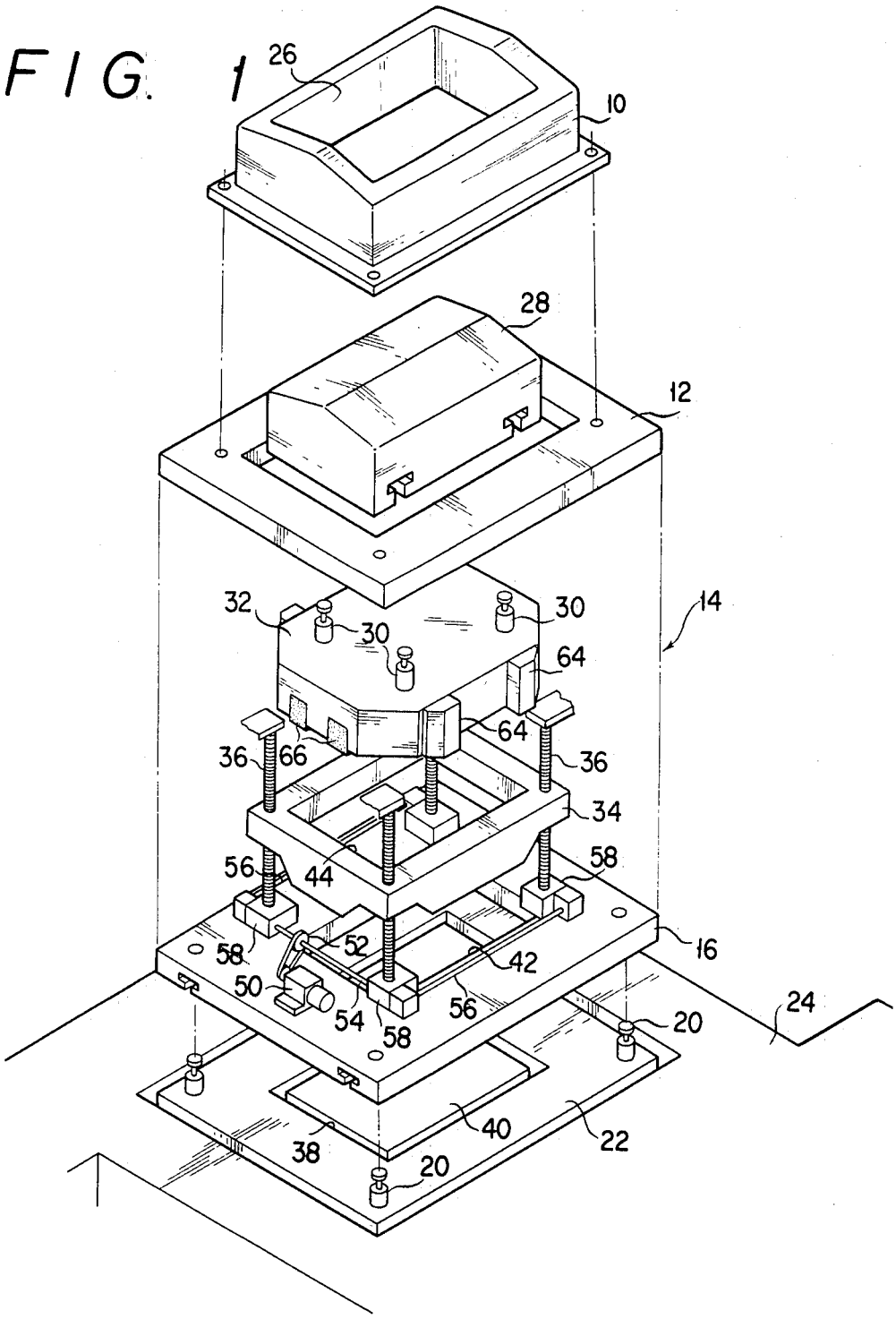
FIG. 1 is an exploded perspective view of the essential parts of the double acting press constructed in accordance with our invention.
Figure 2:
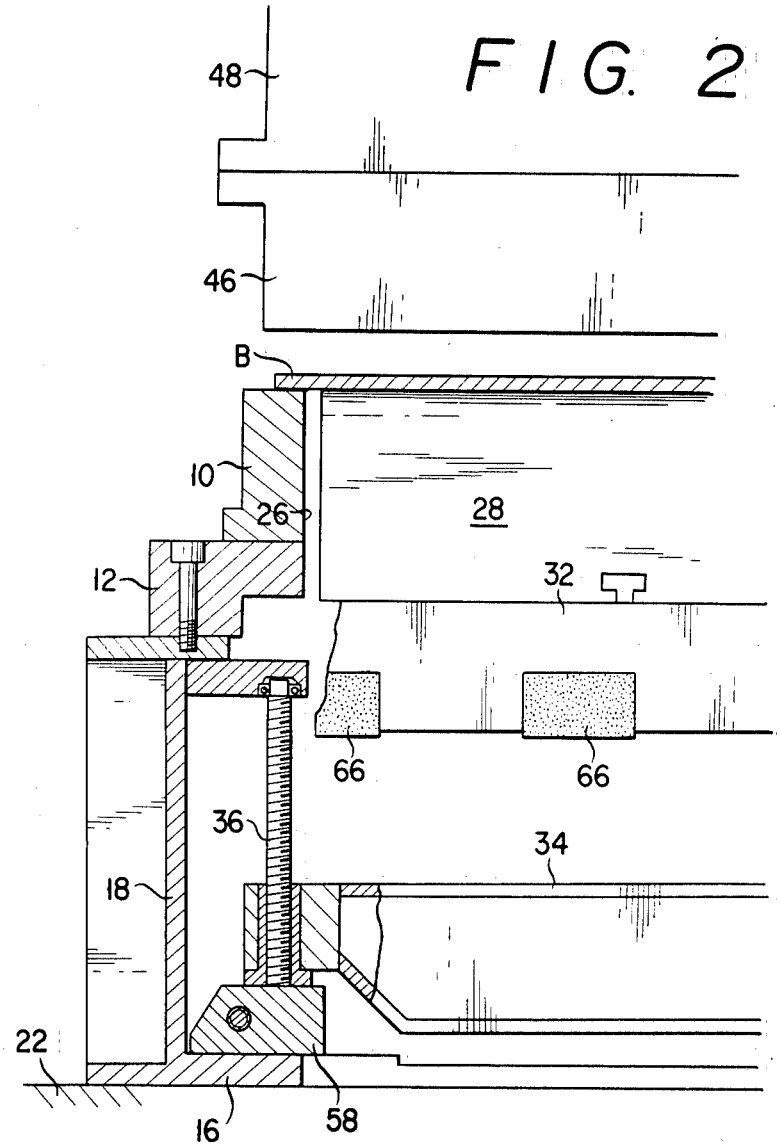
FIG. 2 is a side elevation, with parts shown broken away and parts shown in section for clarity, of the double acting press of FIG. 1, the view showing the die and upper slide which are not shown in FIG. 1.

The general organization of the double acting press in accordance with our invention will best be understood from a consideration of FIG. 1, even though this figure does not show a die and an upper slide, which are both seen in FIG. 2. At 10 in FIG. 1 is shown a hollow blank holder mounted on and fastened to an underlying bolster 12. As will be seen also from FIG. 2, the bolster 12 is fastened to a generally boxlike support 14 having a flat bottom 16 and side walls 18. The bottom 16 of the support 14 is secured by clamps 20 to a blank holder cushion 22 embedded in a bed 24. For the purposes of our invention, the blank holder 10 may be thought of as being substantially rigidly mounted on the bed 20.

Received with clearance in the hollow 26 of the blank holder 10 is a punch 28 which is fastened by clamps 30 to an underlying floating plate 32 accommodated in the support 14. The floating plate 32 is movable up and down with the punch 28 relative to the blank holder 10, bolster 12, etc. Under the floating plate 32 there is provided a floating plate rest 34 on which the floating plate is normally to rest together with the punch 28 thereon. The floating plate rest 34 is supported by four upstanding worms 36 rotatably mounted on the bottom 16 of the support 14. The worms 36 extend through the four corners, respectively, of the floating plate rest 34 in threaded engagement therewith in order to adjustably vary the vertical position thereof in a manner yet to be described.

The blank holder cushion 22 has a hollow 38 in which is received with clearance a lower slide 40 for the up and down motion of the punch 28 with the floating plate 32. The bottom 16 of the support 14 is apertured rectangularly at 42, and the floating plate rest 34 is likewise apertured at 44, in order to allow the lower slide 40 to travel up and down therethrough. When moved upwardly through these apertures 42 and 44, the lower slide 40 makes abutting engagement with the underside of the floating plate 32 resting on the floating plate rest 34. The continued ascent of the lower slide 40 results in the upward travel of the floating plate 32, out of contact with the floating plate rest 34, together with the punch 28.

FIG. 2 indicates that a die 46 is rigidly carried by an upper slide 48 over the punch 28. A sheet metal blank B is to be be engaged between blank holder 10 and die 46, as the latter is lowered by the upper slide 48, and is to be formed by being pressed against the die by the punch 28.

As the lower slide 40 descends after the forming of the blank B, the floating plate 32 comes to rest on the floating plate rest 34 to hold the punch 28 in its lowermost position relative to the blank holder 10. It will be seen, then, that this lowermost position of the punch 28 is adjustably variable relative to the blank holder 10 by changing the vertical position of the floating plate rest 34 with respect to the support 14 which is in a fixed relation to the blank holder 10.

It is for thus changing the vertical position of the floating plate rest 34 that it is supported by and threadedly engaged with the four upstanding worms 36. The joint bidirectional rotation of these worms results in the vertical displacement of the floating plate rest 34 toward or away from the bottom 16 of the support 14. For such joint rotation of the worms 36 there is provided a bidirectional electric drive motor 50 mounted on the bottom 16 of the support 14 and coupled via a chain or belt drive 52 to a drive shaft 54. This drive shaft extends between two neighboring ones of the four worms 36 for driving the two worms via worm gears. The rotation of the drive shaft 54 is further imparted to driven shafts 56 via bevel gears, and the driven shafts 56 rotate the other two worms 36 via worm gears. The worm gears and bevel gears are housed in gear housings 58 and are not seen in FIG. 1.

Figure 3:
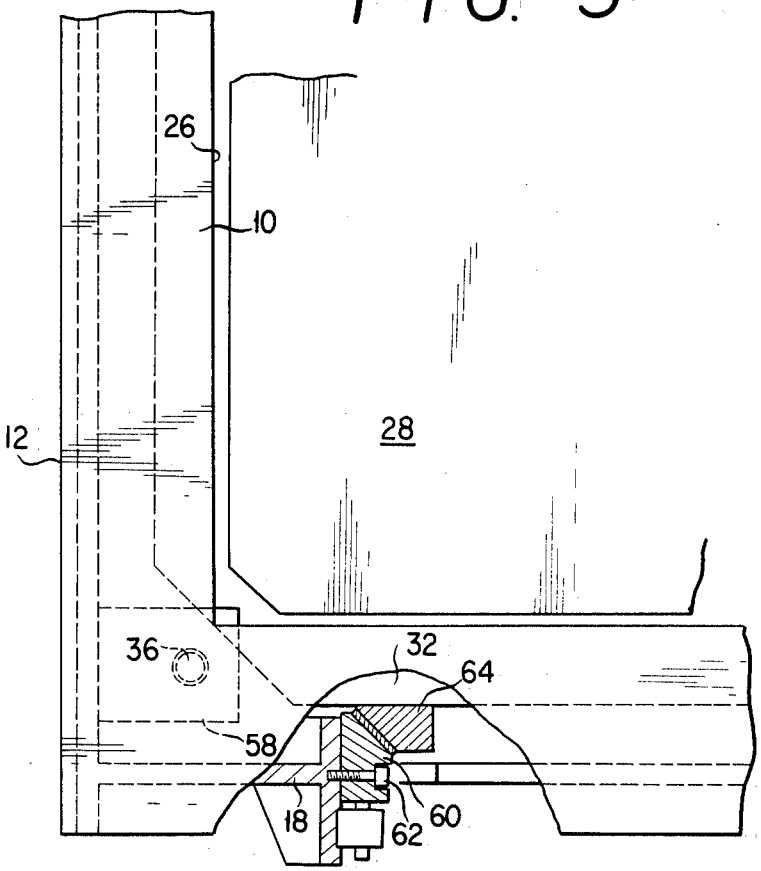
FIG. 3 is a plan view of the double acting press as seen from over the punch, with a part shown broken away and parts shown in section for clarity.

As will be seen from FIGS. 1 and 3, the walls 18 of the support 14 have vertical guide rails, one seen at 60, fastened at 62 thereto. In sliding engagement with these guide rails are slide blocks 64 secured to the floating plate 32, so that this floating plate, together with the punch 28 rigidly mounted thereon, is constrained to vertical reciprocation relative to the support 14.

FIGS. 1 and 2 indicate that the floating plate 32 has cushions 66, such as pieces of polyurethane rubber, provided on its understide. The cushions 66 are intended to mitigate the shocks of the collision of the floating plate 32 with the floating plate rest 34 and with the lower slide 40.

OPERATION

Normally, in the double acting press of the foregoing construction, the lower slide 40 is held fully lowered, and the upper slide 48 held fully raised. The floating plate 32 rests on the floating plate rest 34, holding the punch 28 retracted into the blank holder 10, when the lower slide 40 is fully lowered. The die 46 is held away from the blank holder 10 when the upper slide 48 is fully raised. The blank B to be formed is to be placed on the blank holder 10 and punch 28, as in FIG. 2, when the lower 40 and upper 48 slides are both held retracted as above.

Then the upper slide 48 is lowered to force the die 46 downwardly against the blank holder 10 via the blank B, thereby firmly engaging the blank between die 46 and blank holder 10. Then the lower slide 40 is raised, first into abutment against the cushions 66 on the underside of the floating plate 32 that has been resting on the floating plate rest 34. The lower slide 40 is further raised to move the floating plate 32 upwardly together with the punch 28 thereon, with the floating plate traveling with its slide blocks 64 in sliding contact with the guide rails 60 on the support walls 18, until the punch 28 becomes firmly pressed against the die 46 via the blank B. Thus the blank B is formed between punch 28 and die 46.

During the subsequent descent of the lower slide 40, the floating plate 32 engages the floating plate rest 34 and rests thereon via the cushions 66, allowing the lower slide to descend further out of contact with the floating plate.

With the punch 28 on the floating plate 32 thus stopped in its lowermost position, its top must be coplanar with the top of the blank holder 10. If there is any difference in height between the tops of the blank holder 10 and punch 28, the drive motor 50 may be set into rotation in a direction required to raise or lower the punch 28. The rotation of the drive motor 50 will be imparted to the drive shaft 54 and thence to the driven shafts 56, thereby causing the joint rotation of the four upstanding worms 36 in threaded engagement with the floating plate rest 34. The rotation of the worms 36 results in the upward or downward displacement of the floating plate rest 34, together with the floating plate 32 and punch 28 thereon, relative to the support 14. The drive motor 50 may be set out of rotation when the punch 28 becomes flush with the blank holder 10.

We claim:

1. A double acting press for sheet metal forming, having a hollow blank holder mounted in a substantially fixed relation to a bed, and a punch disposed within the blank holder and moved up and down motion relative to the same by a lower slide, the blank holder coacting with the punch being held in a lowermost position therein for holding thereon a blank to be formed, the blank being formed by being caught between the blank holder and a die forced downwardly by an upper slide and by being pressed against the die by the punch forced upwardly by the lower slide, wherein the improvement comprises:

(a) a floating plate rigidly mounted to the underside of the punch and constrained to joint up and down motion therewith, the lower slide being movable into and out of abutting engagement with the floating plate to cause the up and down motion of the punch relative to the blank holder;

(b) a floating plate rest disposed under the floating plate and movable up and down relative to the bed, the floating plate engaging the floating plate rest and resting thereon when the lower slide is moved downwardly, with the result that the punch on the floating plate is held in the lowermost position within the blank holder as determined by the floating plate rest; and (c) drive means for adjustably moving the floating plate rest up and down relative to the bed;

(d) whereby the lowermost position of the punch can be adjustably varied by changing the vertical position of the floating plate rest by the drive means in order to hold the punch flush with the blank holder so that the blank to be formed may be placed horizontally on the blank holder and the punch.

2. The double acting press of claim 1 wherein the drive means comprises:

(a) a plurality of upstanding worms rotatably supported on the bed and threadedly engaged with the floating plate rest so as to cause the up and down motion of the floating plate rest in response to the joint rotation of the worms; and (b) a drive motor for imparting rotation to the worms.

3. The double acting press of claim 1 wherein the floating plate has cushion means on its underside to reduce the impact of engagement with the lower slide and with the floating plate rest.

4. The double acting press of claim 1 further comprising guide means for guiding the up and down motion of the floating plate.

* * * * *